US007243861B2

(12) United States Patent
Foubert et al.

(10) Patent No.: US 7,243,861 B2
(45) Date of Patent: Jul. 17, 2007

(54) SPRAY NOZZLE

(75) Inventors: Herve Foubert, Angerville la Campagne (FR); Christian Martin, Epone (FR); Bruno Renault, Le Plessis-Grohan (FR)

(73) Assignee: Saint Gobain Ceramiques Avancees Desmarquest, Courbevoie (FR)

( * ) Notice: Subject to any disclaimer, the term of this patent is extended or adjusted under 35 U.S.C. 154(b) by 194 days.

(21) Appl. No.: 10/510,448

(22) PCT Filed: Apr. 8, 2003

(86) PCT No.: PCT/FR03/01103

§ 371 (c)(1),
(2), (4) Date: Oct. 7, 2004

(87) PCT Pub. No.: WO03/084669

PCT Pub. Date: Oct. 16, 2003

(65) Prior Publication Data

US 2005/0224602 A1 Oct. 13, 2005

(30) Foreign Application Priority Data

Apr. 8, 2002 (FR) ..... 02 04335

(51) Int. Cl.
*B05B 1/34* (2006.01)

(52) U.S. Cl. ..... 239/487; 239/490; 239/469; 239/472; 239/599

(58) Field of Classification Search ..... 239/490, 239/488, 472, 470, 463, 487, 469, 467, 464, 239/590, 599, 600, 468
See application file for complete search history.

(56) References Cited

U.S. PATENT DOCUMENTS

| | | | | |
|---|---|---|---|---|
| 1,738,332 | A | 12/1929 | Sutfin | |
| 2,186,804 | A | 1/1940 | Fownes | |
| 3,556,411 | A * | 1/1971 | Nord et al. | 239/581.1 |
| 3,623,660 | A | 11/1971 | Vavassori | |
| 3,758,259 | A * | 9/1973 | Voorheis | 431/9 |
| 4,128,206 | A * | 12/1978 | Bintner | 239/11 |
| 4,570,860 | A * | 2/1986 | Aprea et al. | 239/478 |

FOREIGN PATENT DOCUMENTS

| | | |
|---|---|---|
| DE | 91 934 | 5/1897 |
| FR | 1 512 626 | 2/1968 |
| FR | 2 390 998 | 12/1978 |
| GB | 689 271 | 3/1953 |

OTHER PUBLICATIONS

Database WPI Week 199317 Derwent Publications Ltd., London, GB; AN 1993-141421 XP002226727 & SU 1 708 436 A (SINASKIJ) Jan. 30, 1992 abstract; figures.

* cited by examiner

*Primary Examiner*—Dinh Q. Nguyen
(74) *Attorney, Agent, or Firm*—Young & Thompson

(57) ABSTRACT

A spray nozzle (11) includes a body (12) defining an axial cavity and having, housed in the cavity, from upstream to downstream in the liquid direction of flow X-X', a calibrating nozzle tip (33), a piece called divergent (19) and a piece called convergent (16). More particularly, the calibrating nozzle tip (33) and the convergent (16) are respectively integral with a plug (21) and the nozzle body (12), the plug being hermetically threaded into the cavity of the nozzle body (12) and including at least one gripping zone (22), while the divergent (19) is an independent piece immobilized in the cavity of the nozzle body (12).

16 Claims, 5 Drawing Sheets

Figure 1:
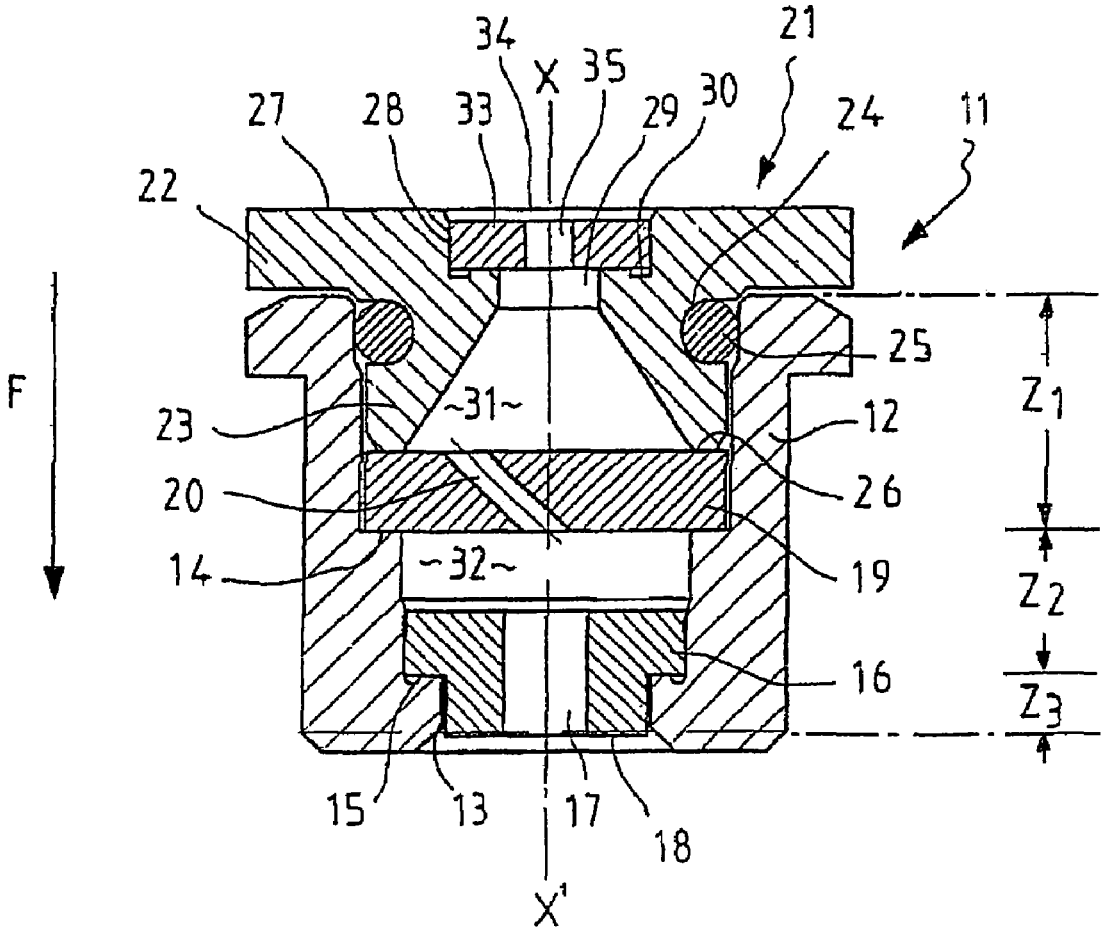

FIG5a
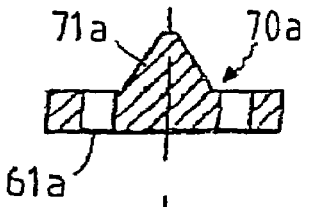
FIG5b
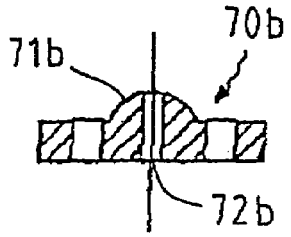
FIG5c
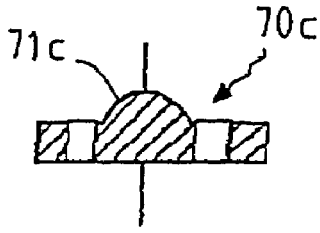
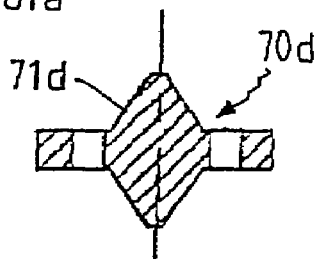
FIG5d
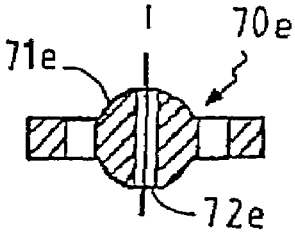
FIG5e
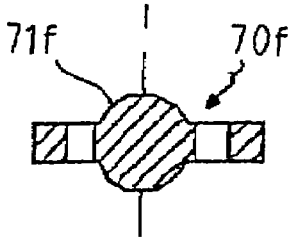
FIG5f
FIG6a
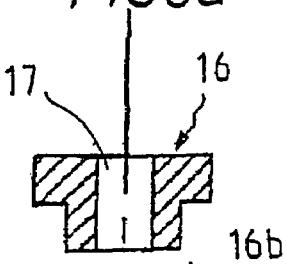
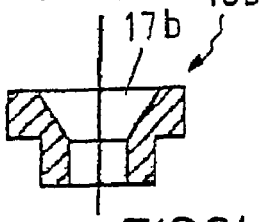
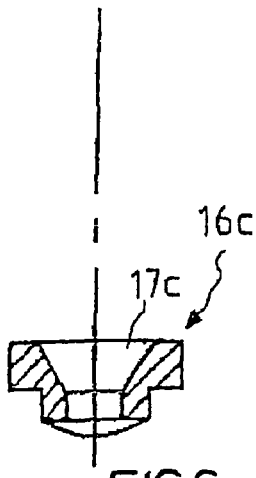
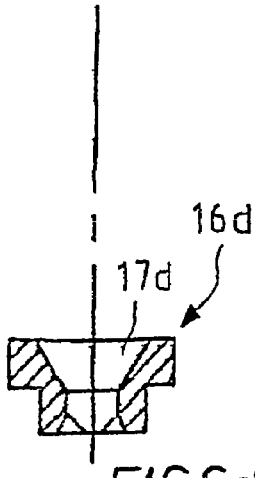
FIG6b
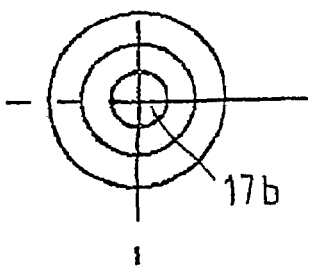
FIG6c
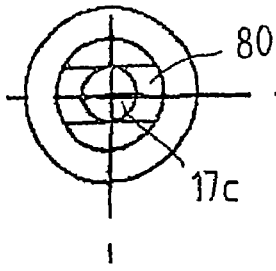
FIG6d
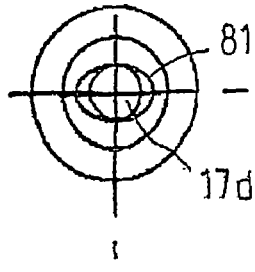

SPRAY NOZZLE

The present invention relates to the field of spray nozzles, more particularly to agricultural spray nozzles. Specifically, the present invention relates to an antidrift spray nozzle, that is to say one which limits the losses of sprayed product.

There are currently various devices aiming to provide good spraying and good distribution of the various plant protection products, such as fertilizers, herbicides, fungicides and insecticides, over the whole of the crops.

The method which is most used nowadays and gives the best results involves spraying said plant protection products, hereinafter referred to as "liquids", over the crops at relatively high pressures. The term "liquids" is intended to mean any medium which can be sprayed, more particularly any solution or suspension irrespective of its viscosity and its surface tension.

In the present description, the term "crop" is intended to mean not only major crops such as, for example, cereal crops but also any other type of cultivation such as, for example, arboriculture, viticulture, etc.

The principle of spraying exploits the properties of liquids, namely the fact that they are non-extensible and incompressible and the fact that they have no inherent shape but assume the shape that they pass through. More particularly, spraying involves splitting a liquid stream into a multitude of droplets of greater or lesser fineness.

Conventionally, spray devices consist of a reservoir, containing the liquid, of a chamber for pressurizing said liquid, of one or more ejection pipes and, at the end of said pipes, of spray nozzles. The main aim of the nozzles is to provide fragmentation of the liquid while at the same time regulating the output, the size of the drops and also the spraying angle.

In practice, the output is determined primarily by the cross section of the passage orifice of the nozzle, but it also depends on the actual properties of the sprayed liquid, namely its density, its viscosity or else its surface tension. In fact, it appears obvious that, with constant pressure, the greater the density and/or viscosity of a liquid, the lower the spraying output. With regard to surface tension, through the action of intermolecular forces the free surface of the liquids behaves like a fine elastic membrane which tends to be spread out as little as possible. The result of this is that a liquid whose surface tension is very high will not be able to be sprayed without difficulty and the supply pressure will have to be considerably increased to make it possible to provide suitable spraying.

The selection of a drop size, otherwise known as particle size, is also important. For example, with regard to a spraying operation requiring maximum exchange between the sprayed liquid and its immediate environment, it will be necessary to select a type of nozzle offering the greatest possible droplet fineness. By contrast, if the desired objective is a spraying operation targeted at long distance, it will be necessary to select the type of nozzle giving relatively large droplets. Furthermore, the type of nozzle selected will have to take account of the spraying output on account of the fact that the lower the output and the higher the pressure, the greater will be the tendency of the droplets to decrease in size.

Finally, a minimum pressure is indispensable for allowing the spraying angle to be correctly formed. Insufficient pressure does not give the liquid particles enough kinetic energy to form a correct jet and excessively high pressure leads to a reduction in the angle formed.

However, managing these parameters is not enough to provide good spraying efficiency owing to the fact that other outside phenomena are additionally involved. Apart from problems connected with poor use of the nozzles, with leaching of the soils or else with uncontrolled wear of said nozzles, there occurs a drifting phenomenon.

The drifting phenomenon, which generally involves the sprayed liquid being disseminated in the air, is a problem which has been studied for a long time, and many tests have been carried out in order to produce a spray nozzle which minimizes the drifting of the product.

In fact, a considerable quantity of liquid may be dispersed away from the target owing to this drifting and, to remedy it, the user tends to increase the quantity of sprayed liquid, which can only be harmful for the environment.

It has been demonstrated that the drifting phenomenon is partly connected with the particle size of the drops at the outlet of the nozzle. More particularly, the larger the diameter of the drops, the less susceptible will they be to drifting. A means of limiting drifting therefore consists in creating a pressure drop within the nozzle by creating a decompression chamber, for example, thereby making it possible, as described above, to obtain droplets of larger diameter.

The spray nozzles therefore play a key role in terms of the efficiency of the spraying operation.

There are currently a number of types of nozzles which can be generally classified into two categories depending on the shape of jets that can be obtained therewith, namely flat jets or conical jets.

Flat jets are obtained by using "slit nozzles" which generally operate on the principle of impaction, that is to say one or more streams of fluid having an inherent velocity is or are caused, by some means or other, to come into contact with a wall or with one another so as to form a spray jet having inherent characteristics depending on the parameters of the fluid, of the wall geometry or else on the surroundings into which the jet will be emitted.

Such nozzles generally consist of an impactor or injector and of a calibration disk. Said impactor/injector and calibration disk may optionally, in certain applications, be coupled to a venturi system.

The main function of the impactor/injector is to bring about the formation of drops and to modify the spraying angle. The addition of a calibration disk generally makes it possible to modify the output of the spraying operation.

It should be noted that, generally, such distinctions as regards the respective functions of the various internal elements constituting the nozzles are only purely theoretical. In practice, it should be understood that all the functions obtained with a given type of nozzle result not from the juxtaposition of the respective functions of each of the constituent parts but from the combination of said functions, this combination leading to a common result. Such a distinction of function is given here only for reasons of clarity in order to facilitate understanding of the present invention.

To return to the slit nozzles, it may be desirable depending on the envisioned applications to add a venturi to them, that is to say a structure whose cross section includes a minimum region, ensuring that the bubbles sprayed onto the target will burst while at the same time increasing their velocity.

However, these nozzles, having identical antidrift properties, are not entirely satisfactory owing to the flat trajectory of the drops which is obtained. In fact, such a trajectory offers poor penetration of the vegetation, which may be detrimental for certain applications.

Furthermore, the working pressures for the slit nozzles do not exceed 5 bar and their design is not suited to withstand, over the long term, pressures which may range from 10 to 25 bar.

Furthermore, it has also been observed that spray jets forming cones, whether hollow or solid, are less subject to drifting phenomena than are conventional jets, such as flat or rectilinear jets, obtained with said slit nozzles.

"Conical spray" nozzles generally operate on the principle of gyrating the fluid, that is to say that the liquid is set in rotation within the nozzle, which makes it possible, at the nozzle outlet, to obtain a jet of conical shape, whether solid or hollow, covering a large area.

These nozzles generally consist of a "convergent" component responsible for the formation of the drops and also for the spraying angle, and of a "divergent" component responsible for the size of the drops but also for the spraying output. As in the case of the slit nozzles, a venturi may be added.

Also known are antidrift nozzles comprising, apart from a divergent part and a convergent part, a calibration disk. Such a structure has the effect of limiting the function of the convergent part to the size of the drops, the output for its part being controlled by said calibration disk.

The divergent parts generally take the form of a helix which may generally have two or more blades, each blade defining with the blade which is directly adjacent to it a duct through which the sprayed liquid passes. Such helices are conventionally referred to as "helices with lateral ducts".

When the liquid is brought under pressure in the nozzle, it will follow the lateral ducts formed between said blades, which will convert the axial energy of the jet into centrifugal energy.

Furthermore, the action of passing through a divergent part increases the pressure drop upstream of the convergent part, making it possible to obtain droplets of larger diameter and limiting the drifting phenomenon all the more.

Although these nozzles constitute real progress in terms of combating the drifting phenomenon of sprayed liquids, they have no less certain disadvantages.

In fact, the production of such nozzles requires that the latter have a relatively large size, which constitutes a major disadvantage in the case of agricultural nozzles when passing, for example, through vegetation which might hook onto and break the nozzles protruding from the protective casings. Moreover, apart from the fact that it is necessary to leave a space for passing the liquid from the axis of the venturi to the periphery of the helix, said helix is particularly fragile and difficult to dimension to a wide range of outputs without having to be penalized from the point of view of the length of the nozzle or the kinetic energy of the liquid.

Furthermore, the existing nozzles of this type, which are particularly susceptible to blocking, cannot be disassembled for cleaning purposes, resulting in rather low spraying efficiencies, for example when a relatively viscous product has been used. In fact, many products used have the tendency to sediment at the end of treatment and thus to clog the orifices.

Another consequence of their inability to be disassembled is that each nozzle has inherent characteristics fixed by manufacture and it is not possible to modify one or other of these characteristics as need be. For example, a given nozzle may be used only for a given pressure range.

To date there has therefore not been a spray nozzle of small size which is disassemblable, capable of being cleaned and able to be used both at high pressure (20 bar) and at low pressure (3 bar).

The present invention aims to overcome all these disadvantages by proposing a spray nozzle consisting, in a manner known per se, of a body defining an axial cavity and having, at one of its ends, an inlet orifice for liquid to be sprayed and, at the other end, a spray orifice, said nozzle comprising, housed in its cavity, from upstream to downstream with reference to the direction of flow X–X' of the liquid, a disk having an axial passage for calibrating the flow of liquid, this passage communicating with said inlet orifice, a "divergent" component whose geometry is designed to divide the flow of liquid into small streams and set them in rotation, and a "convergent" component having an axial passage which communicates with said spray orifice and whose geometry is designed to gather said small streams together into a single jet and to assist in obtaining the desired spraying angle, said calibration disk being secured to a plug fitted hermetically into the cavity in the nozzle body and said convergent part being secured to said nozzle body, the nozzle according to the invention being characterized in that said plug includes at least one grab region protruding from said nozzle body and in that said divergent part consists of an independent component immobilized in the cavity in said nozzle body at a level such that a chamber is formed between said divergent part and said convergent part.

Thus, according to the present invention, it is possible to extract the plug from the nozzle owing to the presence of a grab region provided for this purpose, and to dissociate said divergent part from said nozzle body. Such a dissociation makes it possible, apart from having access to the whole of the nozzle body, to the divergent part and to the convergent part in order to clean them in their entirety, to provide the nozzle with a modular structure, making it possible to replace the divergent part with another divergent part having different characteristics, in particular to adapt the nozzle to the pressure which will be used.

In practice, said calibration disk, divergent part and convergent part are arranged in such a way that a first and second chamber are respectively formed, on the one hand, between said disk and said divergent part and, on the other hand, between said divergent part and said convergent part.

The primary function of said first chamber is to spread the liquid from the disk toward the divergent part. A second function of said first chamber, when using a venturi, is to allow mixing between the liquid and the air provided by said venturi and therefore to promote the formation of drops. In a preferred embodiment, this chamber takes the form of a funnel with its narrow portion oriented on the upstream side, but may take whatever shape provided that it does not conceal the orifices in the divergent part.

With regard to the second chamber, this is necessary for setting the liquid in rotation. In fact, owing to this chamber, air is naturally sucked in through the spray orifice and the convergent part, leading to the formation of an "air column" within said second chamber. The liquid, as it leaves the divergent part, subjected to a centrifugal force, will form a layer around said air column and, consequently, will be set in uniform rotation in the manner of a "tornado". The liquid may then be ejected through the spray orifice in said nozzle in the form of a rotating conical jet.

According to a particularly preferred embodiment of the nozzle forming the subject of the present invention, the divergent part is immobilized in the cavity in the nozzle body, on the downstream side, by simply bearing against a suitably profiled region of the wall of said cavity and, on the upstream side, by said plug.

According to a practical embodiment of the present invention, the suitably profiled region of the wall of the cavity is in the form of a shoulder or of a conical bearing surface.

Preferably, over the whole of its periphery, the divergent part is in free contact, on the downstream side, with the nozzle body and, on the upstream side, with the plug.

According to another possible embodiment, the divergent part is immobilized directly on the plug, for example by screwing, clipping, etc. This immobilization of the divergent part on the plug may or may not be combined with bearing on a suitably profiled region of the cavity in the nozzle body. If the divergent part is immobilized only on the plug and is thus "suspended" above the convergent part, the method of fastening will have to be sufficiently strong to withstand the pressure exerted by the flow of the liquid to be sprayed while still allowing easy disassembly by a user.

The union between the divergent part and the plug may be achieved by providing, on the upstream face of the divergent part, a protuberance which can be accommodated in a recess of corresponding shape formed in the downstream face of the plug and can be retained therein.

The union between the plug and the divergent part not only facilitates manipulation of the various constituent parts of the nozzle forming the subject of the invention, but also helps to keep these various constituent parts in place, and along the same axis.

With regard to the plug, this must be held hermetically in the nozzle body. Although any technique known to a person skilled in the art for holding the plug in such a way may be used, a preferred means involves holding said plug in place in the nozzle body by friction between an O-ring and said body, providing sealing between said plug and said body.

The use of an O-ring makes it possible to achieve in a simple manner a hermetic union between the components and to allow relatively easy removal of said plug. It additionally prevents any risk of accidental fastening between said plug and said nozzle body, which risk exists, for example, when using metal interconnecting or screwing systems which will have a tendency to rust and to "seize up".

Another characteristic feature of the nozzle forming the subject of the present invention lies in the very shape of the divergent part used. Specifically, as described above, it is known practice to use divergent parts taking the form of helices whose blades define ducts which convert the axial energy of the liquid to be sprayed into centrifugal energy. Apart from the fact that such helices are fragile and relatively large, they require the presence of a space, termed mixing chamber, for passing the liquid from the axis of the venturi to the periphery of the helix.

The concern being to reduce the size of the nozzle forming the subject of the present invention, the divergent part used no longer consists of a helix but of a disk having through passages which are oblique and/or in the form of helical portions.

This disk may have flat faces or include, in its central region, projecting shapes which will be described later.

In practice, the disk preferably has a diameter taking up between 5 and 10 mm, the nozzle body having a corresponding internal diameter so that the disk can be fitted therein with gentle friction. As regards the length of the nozzle, this is preferably between 11 and 25 mm and, more particularly, is 18 mm.

The fact that use is made of a divergent part which no longer takes the form of a helix but that of a disk makes it possible, apart from reducing the space requirement, to use the nozzle according to the invention with a much greater pressure range—up to about 20 bar—which was not conceivable beforehand owing to the fragility of the helix due to the presence of salient edges on each duct.

It will be noted that the actual principle of the divergent part has been modified in the sense that it is now responsible only for the size of the drops, not for the spraying output, this latter parameter being governed by the calibration disk (as was the case with slit nozzles).

It is therefore clearly apparent that an additional advantage of the present invention is that it makes it possible to modify the size of the drops while keeping a constant spraying output.

As described above, another advantage is that it is possible to equip the nozzle with one or other of a number of interchangeable divergent parts (differing in terms of their size, shape, etc.), depending on requirements.

Each divergent part is preferably reversible, which prevents the user from wondering about how to position it correctly in the nozzle body.

However, in the event that the divergent part is not reversible, it preferably includes a marker distinguishing its upstream face from its downstream face.

In a preferred embodiment, the passages of the divergent part have an "overall area" of between about 3 and about 15 $mm^2$.

The term "overall area" of the passages is intended to mean the overall area occupied by the hollows, that is to say by the orifices of the passages, on each face of the divergent part.

In practice, the divergent part may include from 1 to about 6 orifices, but preferably it includes 2 to 4 of them. In any event, it should be noted that the important point is not the number of orifices but the overall area occupied by all said orifices.

The spray orifice of the convergent part of the nozzle forming the subject of the present invention may have the flat circular shape of the opening of a cylindrical duct but, in advantageous embodiments, the cylindrical duct may open, on the downstream side, into an elliptical concave space or into a space whose complex shape results from a hollowed-out portion formed in a convex shape and whose axis of symmetry is perpendicular to that of said duct.

More particularly, it is preferred for the largest dimension of said elliptical space or space of complex shape to be between 1 and about 3 mm.

As has been described above, it may be envisioned to combine the base structure of the nozzle according to the invention with means acting as venturi so that suction can be applied in the first chamber.

More particularly, provision may be made for the plug to have, downstream of said calibration disk, transverse air inlet passages designed to come into alignment with air access orifices formed in the nozzle body and opening out level with a passage linking the calibration disk and the divergent part, so as to create a venturi.

In practice, the various constituent parts of the nozzle forming the subject of the present invention may be manufactured from any suitable material, such as plastics, cast or sintered metals or else ceramics. However, with regard to its hardness properties, it is preferred to use ceramics, such as ceramics consisting of aluminas (aluminum oxides), zirconias (zirconium oxides), or else combinations of the two (alumina-zircona).

According to another aspect, the present invention envisions, owing to the modular nature of the nozzle, a spray kit which comprises a nozzle according to the invention and one or more additional divergent parts which differ from that included in the nozzle in terms of the number of passages and/or the diameter of the passages and/or the geometry of the passages and/or the cross-sectional geometry of the divergent part.

Such a kit allows the user to use, at reduced cost, one and the same nozzle in a large number of applications by only changing the divergent part. Thus, the same nozzle may be adapted to various pressures, drop sizes, outputs, etc.

Finally, the present invention also relates to the use of a nozzle or of a kit, as are described above, in an agricultural spray device.

Figure 2A:
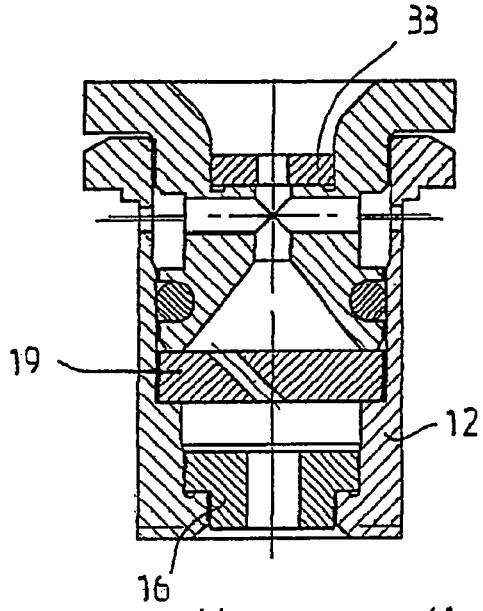
Figure 2B:
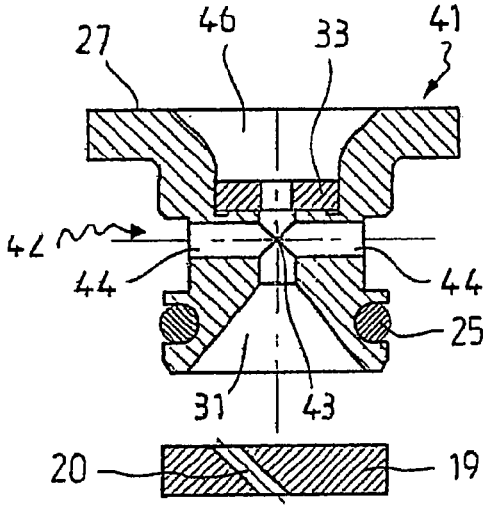
Figure 2B:
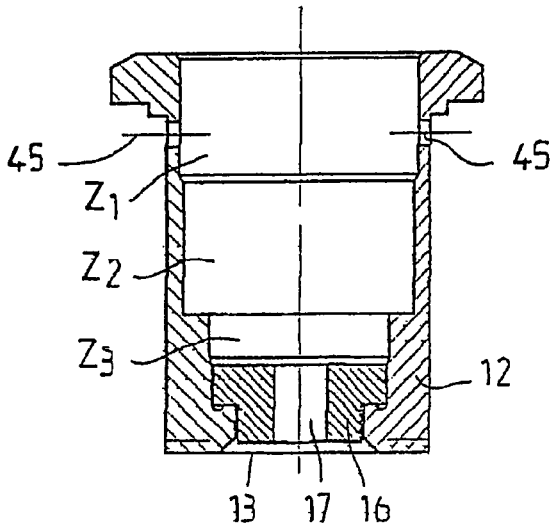
Figure 3A:
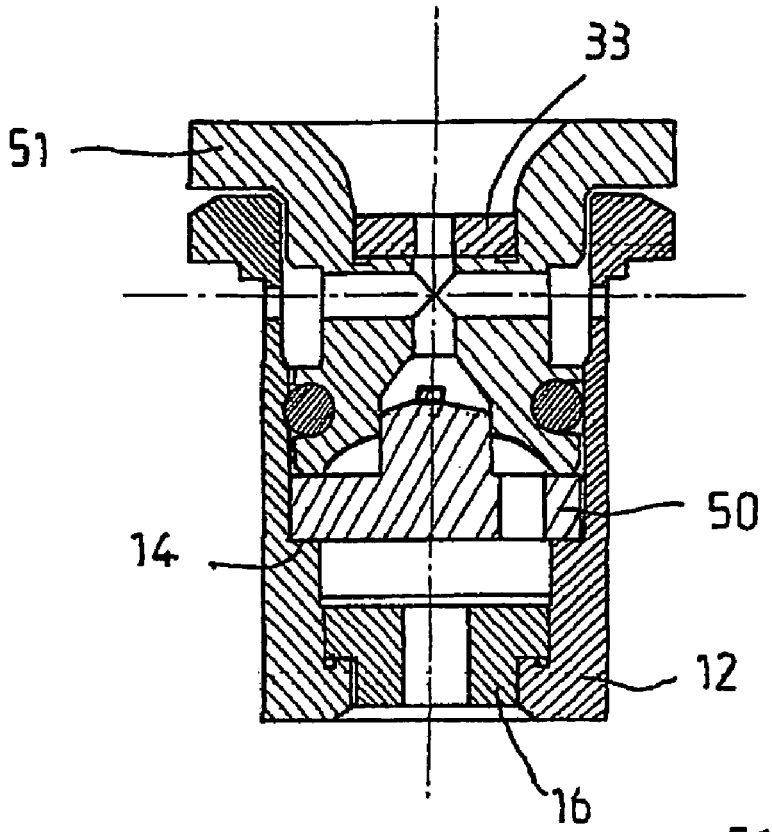
Figure 3B:
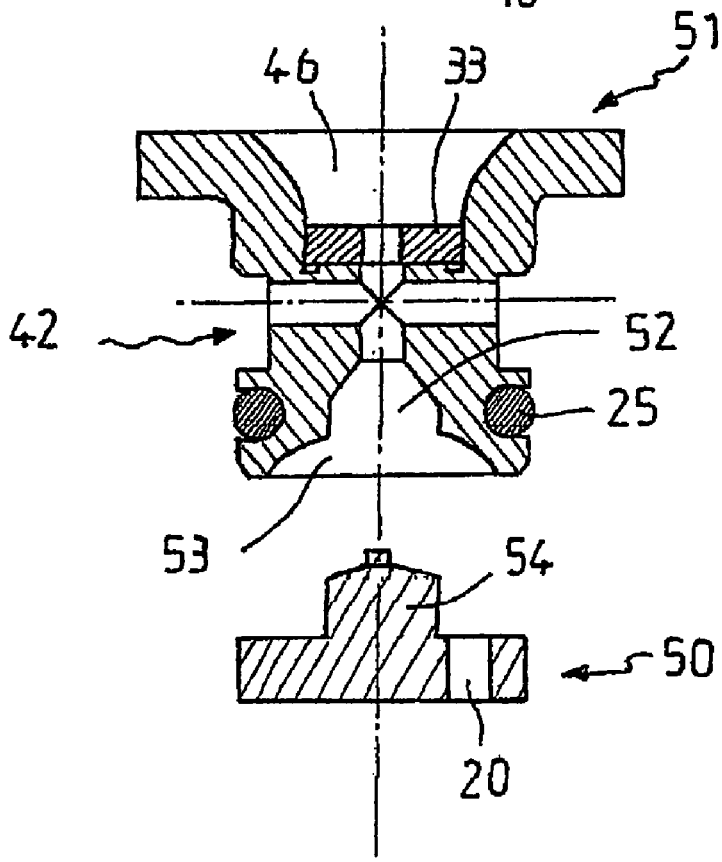
Figure 4A:
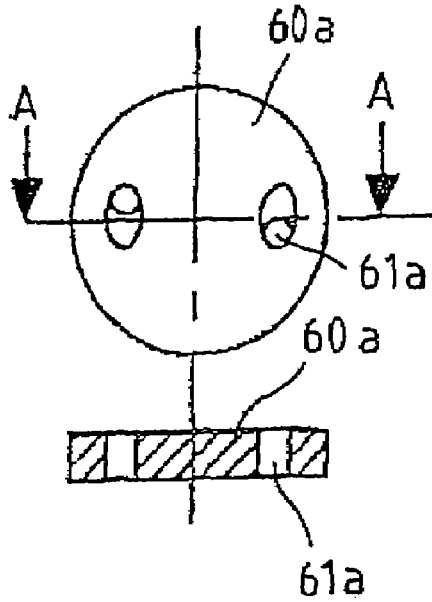
Figure 4B:
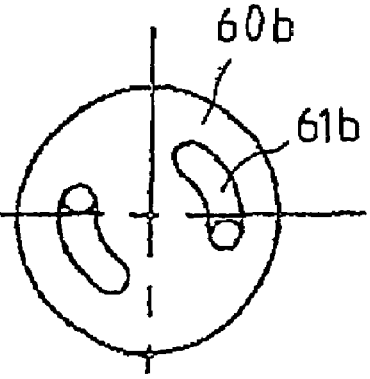
Figure 4C:
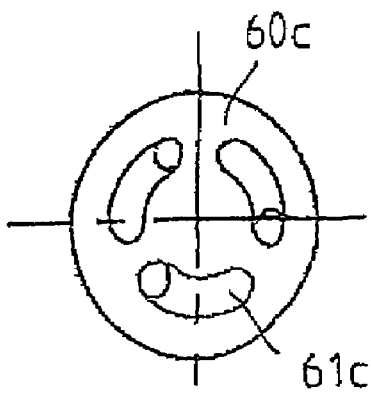
Figure 4D:
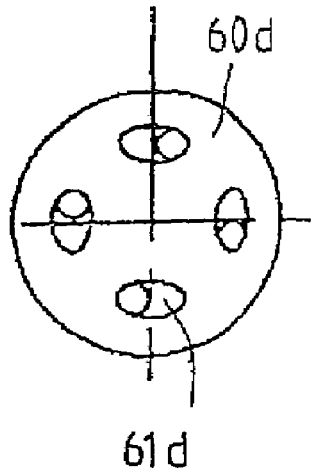

The nozzle forming the subject of the present invention therefore offers a large number of advantages in terms of its antidrift capabilities, its ease of use and its maintenance, which advantages will become more clearly apparent from reading the detailed description below given with reference to the appended drawings, in which:

FIG. 1 represents a section through a first embodiment of the nozzle according to the present invention;

FIG. 2*a* represents a section through a second embodiment of the nozzle according to the present invention;

FIG. 2*b* differs from FIG. 2*a* only in terms of the exploded representation of the elements constituting the nozzle;

FIG. 3*a* represents a section through a third embodiment of the nozzle according to the present invention;

FIG. 3*b* differs from FIG. 3*a* only in terms of the exploded representation of the elements constituting the nozzle, the nozzle body and the convergent part being omitted;

FIGS. 4*a* to 4*d* represent, viewed from above, a set of divergent parts forming the subject of the present invention, a view in section along line A—A of FIG. 4*a* also being represented below this FIG. 4*a*;

FIGS. 5*a* to 5*f* represent, in section, various profiles of divergent parts according to the invention; and FIGS. 6*a* to 6*d* represent, in section, various profiles of convergent parts according to the invention, a view from below of the convergent parts of FIGS. 6*a*, 6*b*, 6*c* and 6*d* also being represented below said figures.

FIG. 1, in which F indicates the direction of flow of the flow of liquid, represents a nozzle 11 according to the present invention. This nozzle 11 consists of a nozzle body 12 in the form of a cup of which the bottom has an opening 13. The internal geometry of said nozzle body 12 determines a first shoulder 14 and, arranged downstream at a predetermined distance from said first shoulder, a second shoulder 15 such that the cavity in the nozzle body 12 includes three regions of decreasing cross section from upstream to downstream (section $Z_1$ upstream of the first shoulder 14, section $Z_2$ between the first and second shoulders 14 and 15, section $Z_3$ downstream of the second shoulder 15).

The nozzle according to the invention additionally includes a bicylindrical "convergent" component 16 having an upstream part with a diameter not much smaller than that of the second section $Z_2$ of the cavity in the nozzle body and a downstream part with a diameter not much smaller than that of the third section $Z_3$ of said cavity, which allows the convergent part to slide in said second section and to come to rest, at the point where there is a change in its cross section, on the shoulder 15, the clearance between the components being so small that the convergent part 16 is wedged in the bottom of the cavity in the nozzle body when it is inserted therein. The convergent part 16 has a duct 17 along the axis X–X' of the nozzle. The convergent part 16 is dimensioned in such a way that its downstream face 18 is slightly set back with respect to the opening 13 in the nozzle body.

The nozzle further includes a "divergent" component 19 which is in the form of a flat-faced disk whose diameter is slightly smaller than that of the first section $Z_1$ of the cavity in the nozzle body, which allows the divergent part to slide in this cavity and to come to rest on the shoulder 14. The divergent part 19 has passages 20 in the form of helical portions, only one of which is visible in FIG. 1.

The nozzle 11 additionally includes a bicylindrical plug 21 having an upstream part 22 whose cross section is greater than that of the first region $Z_1$ of the cavity in the nozzle body and a downstream part 23 whose cross section is slightly smaller than that of said first region $Z_1$ such that said downstream part 23 may slide in said region $Z_1$, while the upstream part 22 bears on the upstream face of the nozzle body 12. A groove 24 is formed in the periphery of the downstream part 23 and it accommodates an O-ring 25.

The downstream part 23 has a height such that, when the upstream part 22 bears on the upstream face of the nozzle body 12, the downstream face 26 of the plug bears on the upstream face of the divergent part 19.

The plug 21 has a cavity whose cross section varies from upstream to downstream. More precisely, the cavity first of all has a cylindrical part 28 with a first diameter, then a cylindrical part 29 with a second diameter which is smaller than the first diameter such that a shoulder 30 is defined between these two parts 28 and 29, then a frustoconical part 31 which defines a first chamber widened out in the downstream direction. The largest diameter of said chamber 31 is such that no passage orifice 20 in the divergent part 19 is covered by the plug 21.

A second chamber 32 is defined between the downstream face of the divergent part 19 and the upstream face of the convergent part 16.

The nozzle finally includes a cylindrical calibration disk 33 having a diameter not much smaller than that of the cylindrical part 28 of the cavity in the plug 21 and having a height which is less than that of said cylindrical part, such that said disk 33 may be inserted into this part and be wedged therein while resting on the shoulder 30, with its upstream face set back with respect to that 27 of the plug, thereby defining an inlet orifice 34. An axial duct 35 is formed in the disk 33.

The nozzle 11 is assembled by simply stacking the components in the nozzle body 12: first of all the convergent part 16, then the divergent part 19, and then finally the plug 21 fitted with its O-ring 25 and with the calibration disk 33.

It will be understood that the divergent part 19 is completely free and that it is immobilized between the downstream face 26 of the plug 21 and the shoulder 14, the plug 21 itself being held in place by the resistance to sliding provided by the O-ring 25.

For their part, the calibration disk 33 and the convergent part 16 are force-fitted into their respective housings so that they remain in place. However, they can be dislodged by being pushed in the opposite direction, if desired.

During operation, the liquid to be sprayed passes under pressure through the inlet orifice 34 and the duct 35 in the calibration disk 33 before being projected into the first chamber 31, where it experiences a first pressure drop. The liquid then enters the passages 20 in the divergent part 19, where its energy, which has been axial up until now, is converted into centrifugal energy owing to the configuration of said passages 20, which force the liquid to take on a circular orientation. The liquid then emerges in the second chamber 32, where it becomes "stuck" about an air column naturally formed by outside air being sucked in through the spray orifice 13 in said nozzle body 12 and through the duct 17 in the convergent part 16. Depending on the parameters of the liquid to be sprayed and on the dimensioning of the elements constituting the nozzle, the liquid will form a layer of greater or lesser thickness about said air column in the chamber 32, and it is this physical phenomenon which makes it possible for a jet of hollow-cone type having an antidrift effect to be projected through the duct 17 and the orifice 13.

In all the other figures, the same numerical references will be employed to denote the same elements as those described above, which elements will not be described again.

FIGS. 2*a* and 2*b* represent another embodiment of the present invention in which a venturi 42 is provided. For this purpose, the second cylindrical part as provided in the cavity in the plug 21 of the embodiment of FIG. 1 is replaced by an axial convergent-divergent pipe 43 in communication with two transverse passages 44. Mutually opposite passages 45 are formed in the nozzle body 12. The pipe 43 opens into the upstream end of the first chamber 31. In this specific case, the chamber 31 provides for the injected air to be mixed with the liquid to be sprayed, which makes it easier to obtain drops.

The nozzle of FIGS. 2*a* and 2*b* additionally differs from that of FIG. 1 in the sense that the first cylindrical part of the cavity in the plug 41 is surmounted by a widened-out part 46 such that the calibration disk 33 is set back further with respect to the upstream face 27 of the plug than in the case of the nozzle of FIG. 1.

The fact that the position of the calibration disk 33 is lowered in this way has the effect of decreasing the distance between the calibration disk 33 and the transverse passages 44, which makes it possible to obtain a maximum pressure reduction effect inside the pipe 43. This has the effect of facilitating priming of the venturi.

Furthermore, the sunken position of the disk indirectly allows better guidance and stabilization of the fluid which might have been disturbed by the upstream line.

FIGS. 3*a* and 3*b* represent yet another embodiment of the invention, which differs essentially from that of FIGS. 2*a* and 2*b* in the way in which the divergent part 50 is assembled. In this case, specifically, the frustoconical part 31 of the cavity in the plug 41 of FIGS. 2*a*, 2*b* is replaced, in the plug 51, by a substantially cylindrical part 52 which is followed by a part 53 sufficiently widened out to prevent the plug 51 from covering the access to the passages, such as 20, of the divergent part 50.

The upstream face of the divergent part 50 has a substantially cylindrical axial protuberance 54 with a diameter not much smaller than that of the part 52 of the cavity in the plug 51 so that it may be inserted therein and retained by friction.

It is clearly apparent from FIGS. 2*b* and 3*b* that the plug, 41 and 51, respectively, can be removed from the nozzle body, the divergent part either being removed simultaneously (case of the divergent part 50 of FIGS. 3*a*, 3*b*) or removed separately, simply by turning the nozzle upside down (case of the divergent part 19 of FIGS. 2*a*, 2*b*).

FIGS. 4*a* to 4*d* for their part represent a number of models of the divergent part, viewed from above and according to the subject of the present invention.

More particularly, these divergent parts all take the form of disks and they differ from one another in terms of the number and/or the configuration of the passages which are formed therein.

The divergent part 60*a* of FIG. 4*a* includes two oblique passages 61*a*. The divergent part 60*b* of FIG. 4*b* likewise includes two passages 61*b* but in the form of helical portions. The divergent part 60*c* of FIG. 4*c* includes three passages 61*c* similar to the passages 61*b*, and the divergent part 60*d* of FIG. 4*d* includes four passages 61*d* similar to the passages 61*a*. As can be seen, these passages 61*a*–61*d* are symmetrically distributed over the whole of the surface of the disks 60*a*–60*d* and are at least oblique with respect to an axis perpendicular to the surface of the disks. The angle formed with said axis may be larger or smaller and preferably be between about 30 and about 50° with respect to the axis of the component.

FIGS. 5*a* to 5*f* each represent variants, in a non-reversible form (FIGS. 5*a*–5*c*) or reversible form (FIGS. 5*d*–5*f*), of divergent parts which can be used in a nozzle according to the present invention. More particularly, FIGS. 5*a* and 5*d* represent divergent parts 70*a*, 70*d* respectively having on their upstream surface or on the upstream and downstream faces a solid conical protuberance 71*a* or solid biconical protuberance 71*d*, the advantage of a biconical protuberance being that it can use the divergent parts in a reversible manner. FIGS. 5*c* and 5*f* show divergent parts 70*c*, 70*f* which differ from those of FIGS. 5*a*, 5*d* in the sense that the conical shape of the protuberances 71*a*, 71*d* is replaced by a hemispherical shape 71*c*, 71*f*. The divergent parts of FIGS. 5*b* and 5*e* readopt the same shapes as those of FIGS. 5*c* and 5*f* as regards their protuberances 71*b*, 71*e*, but, instead of being solid, a passage 72*b*, 72*e* is bored through these protuberances. This passage 72*b* allows the fluid to produce a solid spray cone, as opposed to the hollow spray cones conventionally used.

All the divergent parts represented include passages 61*a* like the divergent part of FIG. 4*a*.

FIGS. 6*a* to 6*d* for their part represent various profiles of convergent parts according to the invention. FIG. 6*a* shows the convergent part 16 used in the embodiment of FIGS. 1, 2*a*–*b* and 3*a*–*b*. The convergent part 16*b* of FIG. 6*b* differs therefrom in that, instead of having a cylindrical duct 17 over its whole length, its duct 17*b* includes a frustoconical part in its upper half and a cylindrical part in its lower half.

FIG. 6*c* shows another embodiment of a convergent part 16*c*, which differs from the convergent part 16*b* in the sense that its downstream face is not flat. Thus, the downstream face of the convergent part 16*c* is convex and hollowed out to form a groove 80 into which the passage 17*c* opens.

As for the convergent part 16*d*, its downstream face is flat, but hollowed out to form an elliptical recess 81 into which the passage 17*d* opens.

Such differences in form at the spray orifices of the convergent parts make it possible to modify the spraying angle and also the shape of the spray cone.

More particularly, modifying the circular spray cone into an elliptical cone allows an improvement in the efficiency of exchange between the carrying air flow and the spray jet. The degree of flattening of the jet corresponds approximately to a factor of 2 between the largest angle—ideally 80°—and the smallest—ideally 40°. In practice, the elliptical jet constitutes an intermediate point between, on the one hand, a slit nozzle as regards the orientation aspect of the jet with respect to the nozzle boom and, on the other hand, a conical-jet nozzle with regard to the trajectory aspect of the drops, allowing effective penetration among the vegetation. The nozzle jet must be oriented with respect to the nozzle boom in such a way as to offer the maximum angle with a slight incidence parallel to the nozzle boom. This results in an increase in the output of the quantity of liquid sprayed onto the target.

The invention claimed is:

1. A spray nozzle consisting of a body defining an axial cavity and having, at one of its ends, an axial inlet orifice for liquid to be sprayed and, at the other end, a spray orifice, said nozzle having a direction of flow from the inlet orifice to the spray orifice and comprising, housed in said cavity, from upstream to downstream with reference to said direction of flow of the liquid, a disk having an axial passage for calibrating the flow of liquid, this passage communicating directly with said inlet orifice, a "divergent" component whose geometry is designed to divide the flow of liquid into small streams and set them in rotation, and a "convergent" component having an axial passage which communicates with said spray orifice and whose geometry is designed to gather said small streams together and to discharge a single cone-shaped jet and to assist in obtaining the desired spraying angle, said calibration disk being secured to a plug fitted hermetically into the cavity in the nozzle body, said divergent part being an independent component immobilized in the cavity in said nozzle body at a level such that a chamber is formed between said divergent part and said convergent part and said convergent part being secured to said nozzle body, characterized in that said divergent part is immobilized in the cavity in the nozzle body, on the downstream side, by simply bearing against a suitably profiled region of the wall of said cavity and, on the upstream side, by said plug.

2. The nozzle as claimed in claim 1, characterized in that said suitably profiled region is in the form of a shoulder or of a conical bearing surface.

3. The nozzle as claimed in claim 1, characterized in that, over its whole periphery, the divergent part is in free contact, on the downstream side, with the nozzle body and, on the upstream side, with the plug.

4. The nozzle as claimed in claim 1, characterized in that said divergent part has, on its upstream surface, a protuberance which can be accommodated in a recess of corresponding shape formed in the downstream face of said plug and can be retained therein.

5. The nozzle as claimed in claim 1, characterized in that said divergent part is a disk having through passages which are oblique and/or in the form of helical portions.

6. The nozzle as claimed in claim 1, characterized in that said divergent part is a reversible disk having through passages which are oblique and/or in the form of helical portions.

7. The nozzle as claimed in claim 1, characterized in that said divergent part is a disk having through passages which are oblique and/or in the form of helical portions, said disk including a marker distinguishing its upstream face from its downstream face.

8. The nozzle as claimed in claim 1, characterized in that said divergent part is a disk having through passages which are oblique and/or in the form of helical portions, said passages having an "overall area" of between about 3 and about 15 $mm^2$.

9. The spray nozzle as claimed in claim 1, characterized in that the duct in the convergent part opens, on the downstream side, into an elliptical concave space or into a space whose complex shape results from a hollowed-out portion which is formed in a convex shape and whose axis of symmetry is perpendicular to that of said duct.

10. The spray nozzle as claimed in claim 1, characterized in that said plug includes at least one grab region protruding from said nozzle body.

11. The nozzle as claimed in claim 1, characterized in that said plug is held in place in the nozzle body by friction between an O-ring and said body, providing sealing between said plug and said body.

12. The spray nozzle as claimed in claim 1, characterized in that said plug has, downstream of said calibration disk, transverse air inlet passages designed to come into alignment with air access orifices formed in the nozzle body and opening out level with a convergent-divergent passage, so as to create a venturi.

13. The nozzle as claimed in claim 1, characterized in that the divergent part has a diameter which takes up between 5 and 10 mm.

14. The nozzle as claimed in claim 1, characterized in that its length is between 11 and 25 mm, and is preferably 18 mm.

15. A spray kit comprising a nozzle as claimed in claim 1 and one or more additional divergent parts which differ from that included in the nozzle in terms of the number of passages and/or the diameter of the passages and/or the geometry of the passages.

16. The use of a nozzle as in claim 1, in an agricultural spray device.

* * * * *